United States Patent [19]

Vander Voort

[11] 4,353,743

[45] Oct. 12, 1982

[54] STEEL COMPOSITION FOR CHIPPER KNIFE

[75] Inventor: George F. Vander Voort, Bethlehem, Pa.

[73] Assignee: Bethlehem Steel Corporation, Bethlehem, Pa.

[21] Appl. No.: 217,650

[22] Filed: Dec. 18, 1980

Related U.S. Application Data

[62] Division of Ser. No. 43,069, May 29, 1979, Pat. No. 4,287,007.

[51] Int. Cl.[3] ..... C22C 39/02

[52] U.S. Cl. ..... 75/124; 75/126 C; 75/126 F; 75/128 G; 75/128 W

[58] Field of Search ..... 75/126 C, 128 W, 124 B, 75/126 F, 128 G

[56] References Cited

U.S. PATENT DOCUMENTS 3,044,872 7/1962 Hayes et al. ..... 75/126 C

FOREIGN PATENT DOCUMENTS 2039438 2/1972 Fed. Rep. of Germany .... 75/126 C
508560 6/1976 U.S.S.R. ..... 75/124 B
598954 2/1978 U.S.S.R. ..... 75/126 C

*Primary Examiner*—M. J. Andrews

*Attorney, Agent, or Firm*—Joseph J. O'Keefe; William B. Noll

[57] ABSTRACT

A ferrous alloy suitable for use as a knife in a rotary wood chipper, said alloy consisting essentially of, by weight,

| | Broad (%) | Preferred (%) |
|---|---|---|
| Carbon | .40–.60 | .45–.50 |
| Manganese | 1.0 max. | .20–.40 |
| Phosphorus | 0.035 max. | 0.025 max. |
| Sulfur | 0.035 max. | 0.025 max. |
| Silicon | 1.50 max. | .30–.50 |
| Nickel | 2.00 max. | .25–.35 |
| Chromium | 4.0–6.0 | 4.6–4.8 |
| Molybdenum | 1.0–3.0 | 1.9–2.1 |
| Aluminum | 0.10 max. | 0.010–0.030 |
| Iron* | balance | balance |

*includes optional additions in nominal amounts of columbium, titanium, vanadium, tungsten, cobalt.

The alloy, in a heat-treated condition, is characterized by (1) a high level of toughness on the order of 100 ft-lbs min. on unnotched specimens, (2) good wear resistance, (3) good machinability, (4) a hardness of at least 56 HRC after a double temper at 950° F. or higher, and (5) being hardenable using a maximum of 1850° F. as the austenitizing temperature.

8 Claims, 3 Drawing Figures

STEEL COMPOSITION FOR CHIPPER KNIFE

This is a division of application Ser. No. 043,069, filed May 29, 1979 now U.S. Pat. No. 4,287,007.

BACKGROUND OF THE INVENTION

This invention is directed to a ferrous alloy for use as a knife in wood chipping apparatus. More particularly, the invention relates to a heat treated alloy steel, which when formed into knives is especially adaptable for rotary wood chippers. Though suitable as knives for soft and hard wood chippers, the further description of the alloy of this invention will be directed to its use in hardwood chippers. As a consequence, the demands on the knives used therein will be better appreciated.

Hardwoods, such as oak, walnut, cherry, maple and ash, are processed for chipping by first sizing the logs to lengths of four to six feet and diameters up to 21 inches. After debarking and washing, the logs are conveyed to the chipper, where, in a matter of a few seconds, the logs are converted into chips. A hardwood chipper may typically use fifteen (15) knives, radially arranged in a drum rotating at from 2000–3000 rpm.

The life of a chipper knife, whose radial edge comprises the cutting or chipping portion of the knife, varies considerably. The knives may be worn or dulled through normal chipping, damaged through contact with foreign objects such as nails or knots in the wood, or affected by chipping frozen logs from wood cut in winter.

While the wood chipper described above has been the traditional device for creating wood chips, recent years have seen the popularization of portable "tree harvesters." These devices are moved to the logging area where it chips logs without recourse to debarking or trimming to length. The chips are fed into a waiting truck and then taken to the pulp mill for processing. These portable chippers do not possess the same degree of knife support as provided in the larger stationary chipper. Hence, knife failures due to gross fracture occur much more frequently in the portable units compared to experience with knives in stationary units. The knives in the portable unit are the same size as in the stationary units but only three are used.

Heretofore, to meet the harsh demands of chipper knives, the grade of steel used therefor comprised, by weight,

| | |
|---|---|
| C | .45–.50% |
| Mn | .20–.40% |
| Si | .80–1.0% |
| Cr | 8.0–9.0% |
| Mo | 1.20–1.50% |
| W | 1.0–1.40% |
| V | .20–.40% |
| Fe | balance |

For use as knives, such steel is quenched and tempered to 56/58 HRC, i.e. austenitized at 1850° F. (1010° C.), oil quenched, and double tempered at 975° F. (524° C.).

The most important characteristics of chipper knives are edge retention and toughness. Other significant considerations are ease of heat treatment, machinability, and dimensional stability. However, attainment of these desirable attributes are commercially meaningless if cost is not competitive. For the first time, the alloy steel of this invention brings together all such attributes, and at a competitive cost. As a consequence, the alloy steel of this invention is superior to the current grade now being used for chipper knives.

SUMMARY OF THE INVENTION

This invention is directed to a ferrous alloy suitable for use as a knife in a rotary wood chipper. The ferrous alloy of this invention, for its preferred use, comprises a quenched and tempered, essentially rectangular plate having a beveled edge along one side thereof for chipping. The chemistry of said alloy consists essentially of, by weight,

| | Broad (%) | Preferred (%) |
|---|---|---|
| Carbon | .40–.60 | .45–.50 |
| Manganese | 1.0 max. | .20–.40 |
| Phosphorus | 0.035 max. | 0.025 max. |
| Sulfur | 0.035 max. | 0.025 max. |
| Silicon | 1.50 max. | .30–.50 |
| Nickel | 2.00 max. | .25–.35 |
| Chromium | 4.0–6.0 | 4.6–4.8 |
| Molybdenum | 1.0–3.0 | 1.9–2.1 |
| Aluminum | 0.10 max. | 0.010–0.030 |
| Iron* | balance | balance |

*includes optional additions in nominal amounts of columbium, titanium, vanadium, tungsten, cobalt.

The ferrous alloy plate, after dressing and heat treatment to form a knife, where such heat treatment includes a maximum austenitizing temperature of 1850° F. (1010° C.) and a double temper at 950° F. (510° C.) or higher, is ready for use in a rotary wood chipper. For such use, the knife is characterized by (1) a high level of toughness on the order of 100 ft-lbs min. on unnotched specimens, (2) good wear resistance, (3) good machinability, and (4) a hardness of at least 56 HRC.

DETAILED DESCRIPTION OF PREFERRED EMBODIMENT

This invention is directed to a ferrous alloy possessing good toughness, wear resistance and machinability, and a hardness of at least 56 HRC after a quench and temper heat treatment. More particularly, this invention is directed to such ferrous alloy adapted for use as a knife in a rotary wood chipper. Though the superior properties may suggest other and diverse applications for the ferrous alloy of this invention, the further description will be limited to such preferred use. However, the scope of this invention should not be so restricted.

In order to more fully appreciate the preferred use, and the demands thereon, of the ferrous alloy of this invention, a brief discussion of a typical stationary rotary hardwood chipper may be helpful. For this discussion reference is made to FIGS. 1 and 2 illustrating such typical rotary wood chipper.

Figure 1:
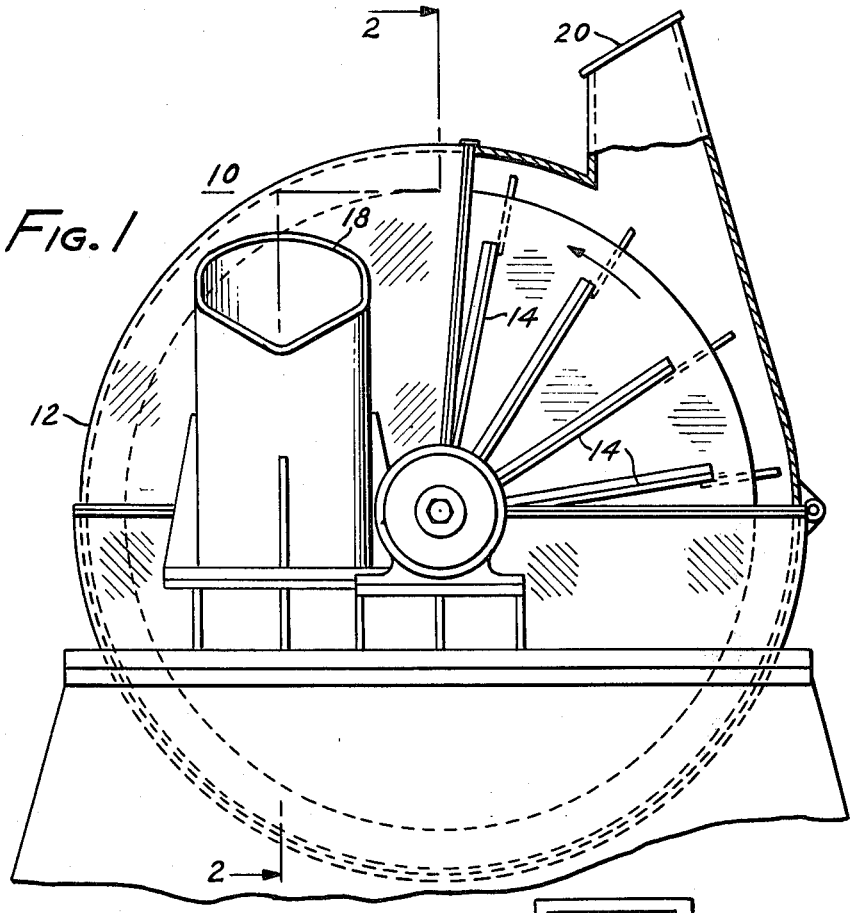
FIG. 1 is a partially sectioned plan view of a stationary rotary wood chipper utilizing a chipper knife from the ferrous alloy of this invention.
Figure 2:
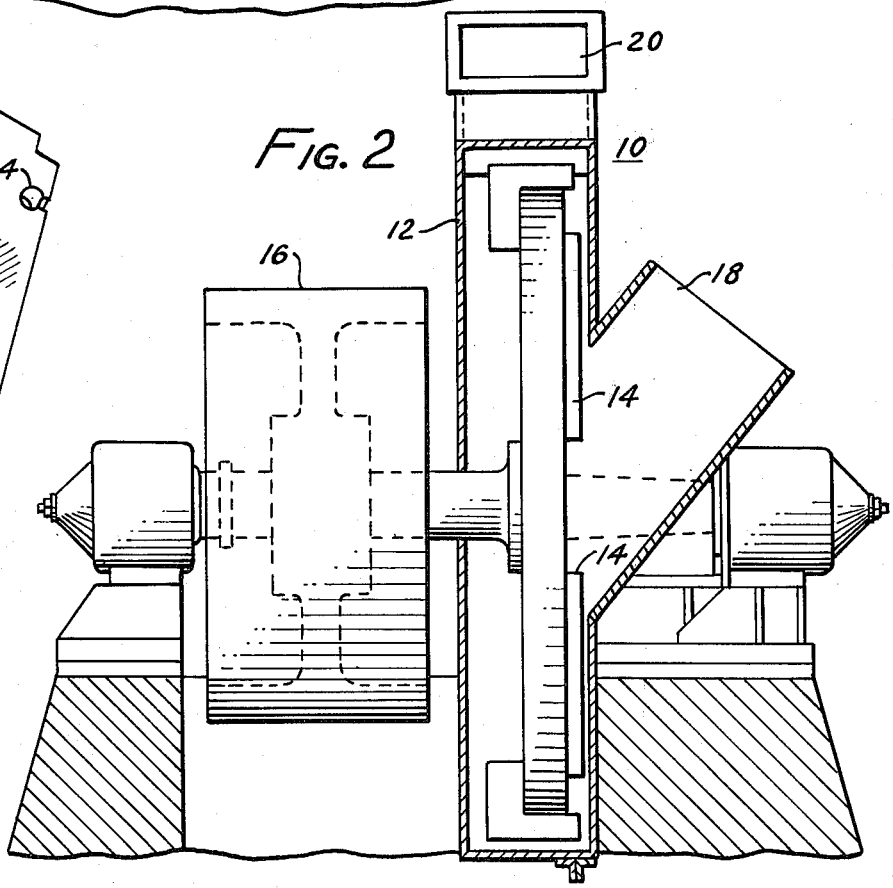
FIG. 2 is a sectional view taken along line 2—2 of FIG. 1.

FIGS. 1 and 2 illustrate the various components of a rotary wood chipper 10. Chipper 10 comprises a drum 12, typically up to 120 inches in diameter, housing a plurality of radially disposed knives 14 mounted for rotation in drum 10. A large flywheel 16 drives the knives 14 at a rate of between 2000 and 3000 rpm.

Logs, 4 to 6 feet in length and a maximum diameter of 21 inches, are fed through chute 18 into contact with the rotating blades 14. Within a matter of seconds, each log is consumed and the chips thereof caused to exit through portal 20.

Figure 3:
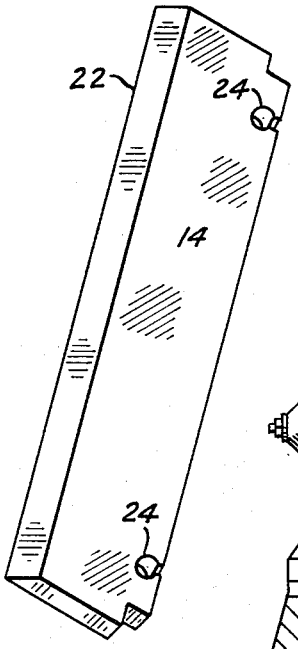
FIG. 3 is a perspective view of a typical chipper knife manufactured from the ferrous alloy of this invention.

FIG. 3 illustrates a typical, generally rectangular chipper knife 14. Though dimensions may vary, the hardwood chipper knife illustrated in FIG. 3 is initially 30 inches×5 inches×½ inch. The knife 14 is characterized by a beveled chipper edge 22 and a series of holes 24 along the opposite or rear edge of the knife. So long as there is no significant damage to the beveled chipper edge 22, the knife may be redressed or ground for reuse. However, to insure a constant edge protrusion as shown in FIG. 2, lead spacers are molded into holes 24. That is, prior to regrinding, the old spacers in holes 24 are removed, and the knife is ground and then placed in a fixture and new spacers are cast.

The reasons for replacing knives are many, but for convenience can be grouped into two modes of knife failure. The first is breakage or edge chipping generally due to striking a foreign object such as a nail or embedded barbed wire. The second mode of failure is general dulling of the edge. Once either of these modes occur, considerable localized heat will be generated at the dull spot. Such heat can affect the metallurgical properties of the knife and seriously limit the further use of the knife.

Obviously, a material which can prolong knife performance by resistance to edge chipping and dulling is desirable and, in fact, necessary. The ferrous alloy of the present invention offers such a material. Criteria for the development of such ferrous alloy were a (1) high tempered hardness to provide resistance to softening from frictional heat, (2) improved toughness to prevent breakage or edge chipping, and (3) high wear resistance to minimize edge dulling.

Such criteria has now been realized with the discovery of the present invention: a ferrous alloy consisting essentially of, by weight,

| | Broad (%) | Preferred (%) |
|---|---|---|
| Carbon | .40–.60 | .45–.50 |
| Manganese | 1.0 max. | .20–.40 |
| Phosphorus | 0.035 max. | 0.025 max. |
| Sulfur | 0.035 max. | 0.025 max. |
| Silicon | 1.50 max. | .30–.50 |
| Nickel | 2.00 max. | .25–.35 |
| Chromium | 4.0–6.0 | 4.6–4.8 |
| Molybdenum | 1.0–3.0 | 1.9–2.1 |
| Aluminum | 0.10 max. | 0.010–0.030 |
| Iron* | balance | balance |

*includes optional additions in nominal amounts of columbium, titanium, vanadium, tungsten, cobalt.

Such alloy, in a quenched and tempered condition, is characterized by (1) a high level of toughness on the order of 100 ft-lbs min. on unnotched specimens, (2) high wear resistance, (3) good machinability, (4) a hardness of at least 56 HRC after a double temper at 950° F. or higher, and (5) being hardenable using a maximum of 1850° F. as the austenitizing temperature.

While the real measure of the suitability of the ferrous alloy of this invention for chipper knives is the actual use thereof, certain quantitative tests indicate the potential of such ferrous alloy for the intended application. In this regard, a series of ferrous alloys according to this invention were prepared and heat treated. Against such ferrous alloys a standard steel commonly used for chipper knives was compared. The chemistries and properties of the respective materials are presented below.

TABLE I

| | Chemistry Weight, % | | | | | | | | | | | | |
|---|---|---|---|---|---|---|---|---|---|---|---|---|---|
| Inv. Alloys | C | Mn | P | S | Si | Ni | Cr | Mo | Nb | Ti | Al | W | V |
| A | .48 | .37 | .011 | .014 | .67 | .33 | 4.70 | 2.07 | — | .005 | .018 | — | — |
| B | .46 | .35 | .004 | .015 | .68 | .34 | 4.76 | 2.03 | .03 | .006 | .029 | — | — |
| C | .50 | .35 | .007 | .013 | .70 | .33 | 4.76 | 1.98 | — | .08 | .025 | — | — |
| D | .48 | .84 | .012 | .014 | .65 | .32 | 4.75 | 1.98 | — | .009 | .031 | — | — |
| E | .48 | .77 | .009 | .013 | .15 | .32 | 4.74 | 1.97 | .005 | .007 | .018 | — | — |
| F | .47 | .76 | .004 | .012 | .19 | .32 | 4.75 | 2.00 | .045 | .007 | .016 | — | — |
| G | .47 | .80 | .010 | .009 | .24 | .33 | 4.75 | 1.37 | .052 | .005 | .019 | — | — |
| Standard | .51 | .28 | .013 | .004 | 1.08 | .18 | 8.04 | 1.28 | — | — | .002 | 1.0 | .28 |

TABLE II

| | | Tempered* Hardness and Unnotched Impact Strength** | | | | | | | | | |
|---|---|---|---|---|---|---|---|---|---|---|---|
| | (Austenitizing) | 950° F. | | 960° F. | | 980° F. | | 1000° F. | | 1020° F. | |
| Alloy | (Temperature) | Ft-lbs | HRC | Ft-lbs | HRC | Ft-lbs | HRC | Ft-lbs | HRC | Ft-lbs | HRC |
| A | (1850° F.) | | | 124 | 59.5 | 137 | 58.5 | 139 | 57.5 | 206 | 56.5 |
| B | (1850° F.) | | | 147.5 | 58.5 | 206 | 57.7 | 229 | 57 | 238 | 56 |
| C | (1850° F.) | | | 123 | 59.5 | 112 | 58 | 183 | 57 | 236 | 56 |
| D | (1850° F.) | | | 91 | 59 | 99 | 58.5 | 122 | 58.5 | 130 | 56.5 |
| E | (1850° F.) | | | 187 | 59 | 201 | 58 | 250 | 56.5 | 243 | 55 |
| F | (1850° F.) | | | 220 | 57.5 | 194 | 56.5 | 221 | 56 | 260 | 55 |
| G | (1850° F.) | | | 230 | 56.5 | 192 | 55 | 244 | 54 | 254 | 52 |
| Std. | (1850° F.) | 58.3 | 58 | | | | | | | 104.3 | 55 |
| Std. | (1900° F.) | 48.3 | 60 | | | | | | | 107.7 | 58.5 |
| Std. | (1950° F.) | 76.3 | 60.5 | | | | | | | | |

*All alloys austenitized, oil quenched and double tempered at the indicated temperatures.
**Impact strengths are unnotched impact samples at 75° F., longitudinal orientation, average of three tests.

Table II very dramatically demonstrates the superior combination of hardness and toughness of the ferrous alloy of this invention. Through experience gained from numerous trials for such an alloy in chipper knife applications, it was found that the quantitative measures of hardness and toughness reflect the suitability of this alloy for the demanding requirements of chipper knife applications. Such superior combination of properties was discovered through an intensive investigation of various alloying additions to steel, and to the careful balancing of same, so as to be fully responsive to a quench and temper heat treatment.

To illustrate the critical balancing of the additions for the ferrous alloy according to this invention, a series of laboratory samples were prepared and heat treated. The chemistries are reported in Table III and the properties in Table IV.

TABLE III

| | Chemistry Weight, % | | | | | | | | | | | |
|---|---|---|---|---|---|---|---|---|---|---|---|---|
| Alloy | C | Mn | P | S | Si | Ni | Cr | Mo | V | Ti | Nb | Al |
| H | .55 | .40 | .001 | .009 | .75 | .06 | 7.7 | 1.40 | 1.10 | .006 | .005 | .011 |
| J* | .55 | .41 | .002 | .009 | .86 | .05 | 6.00 | 1.43 | 1.20 | .006 | .005 | .011 |
| K* | .55 | .41 | .010 | .007 | .71 | .05 | 4.04 | 1.52 | 1.11 | .003 | .005 | .012 |
| L* | .52 | .38 | .013 | .009 | .66 | .05 | 4.05 | 1.49 | .03 | .11 | .005 | .005 |
| M | .57 | .38 | .011 | .011 | .80 | .05 | 4.14 | .02 | 1.12 | .12 | .005 | .009 |
| N* | .61 | .34 | .010 | .008 | .90 | .05 | 4.05 | 1.50 | 1.03 | .12 | .005 | .030 |
| P | .61 | .25 | .014 | .009 | .81 | .05 | 4.13 | 1.49 | .03 | .18 | .005 | .006 |
| Q | .60 | .34 | .010 | .007 | .92 | .05 | 4.13 | .01 | 1.01 | .18 | .005 | .006 |
| R* | .63 | .40 | .012 | .007 | .71 | .05 | 3.97 | .98 | 1.06 | .16 | .05 | .009 |
| S | .53 | .30 | .007 | .009 | .85 | .09 | 1.93 | 1.95 | .01 | .003 | .08 | .013 |
| T | .56 | .27 | .003 | .009 | .81 | .09 | 1.93 | 1.92 | .01 | .005 | .08 | .009 |
| U | .52 | .31 | .007 | .009 | .88 | .09 | 1.91 | 2.90 | .02 | .004 | .08 | .014 |
| V | .51 | .29 | .003 | .009 | .86 | .08 | 1.97 | 3.95 | .02 | .006 | .08 | .013 |

*Alloys according to the present invention

TABLE IV

| Tempered* Hardness and Unnotched Impact Strength** | | |
|---|---|---|
| Alloy | Ft-lbs | HRC |
| H | 50.3 | 59 |
| J | 109.3 | 58 |
| K | 225 | 55.5 |
| L | 185.3 | 56 |
| M | 161.3 | 51.5 |
| N | 118 | 57 |
| P | 66 | 57.5 |
| Q | 112 | 52 |
| R | 147 | 56 |
| S | 218 | 55 |
| T | 174 | 55 |
| U | 139 | 55 |
| V | 85 | 56 |

*All samples austenitized at 1850° F., oil quenched, and double tempered at 950° F.
**Average of three longitudinal unnotched Charpy samples The need for maximizing toughness while maintaining high hardness and wear resistance, that is, balancing the chemistry to optimize performance of the alloy of this invention dictated the choice and amounts of alloying additions. Also, this problem was further complicated by the need to minimize alloy costs. Therefore, particular concern was given to the major alloying additions such as carbon, chromium, molybdenum, silicon, nickel and manganese.

Carbon

To insure attainment of the required hardness level, carbon between about 0.40–0.60%, preferably between about 0.45–0.50%, by weight, must be used. Increasing the carbon above about 0.60%, while promoting wear resistance, decreases toughness and may cause difficulties with excessive formation of retained austenite, i.e. in excess of about 10%. Compare, for example, Alloys L and P. The significant difference is the carbon level, 0.52% and 0.61%, respectively. Alloy P clearly suffered a loss in toughness as a result of the higher carbon content. High carbon contents, on the order of 0.60% and higher, depress the martensite-start temperature such that upon quenching not all of the austenite is transformed to martensite. One method of minimizing the presence of retained austenite in high carbon steels is by the addition of carbide forming elements such as vanadium and titanium. Such elements tie up a portion of the carbon thereby limiting the carbon available to go into solution at the austenitizing temperature prior to quenching. Compare, for example, Alloys N and P. An obvious difference between such alloys is the vanadium content, 1.03% and 0.03%, respectively. Vanadium is a strong carbide forming element.

Chromium

The addition of chromium imparts hardenability, dimensional stability and resistance to softening during tempering. This latter property is quite important to the alloy of this invention to achieve high hardness with tempering at about 950° F. However, it was discovered, as demonstrated by Alloys H, J and K, that high levels of chromium reduce toughness dramatically. As a consequence, chromium should be present in an amount between about 4.0–6.0%, by weight, preferably between about 4.4–5.2%, and more preferably between about 4.6–4.8%.

Molybdenum

Some of the resistance to softening during tempering is provided by molybdenum. Molybdenum imparts hardenability. However, excessive amounts may cause a reduction in toughness. Consequently, a balance in the amount of chromium and molybdenum must be obtained to give the required tempered hardness without significantly reducing toughness. To achieve such balance, molybdenum must be present in an amount between about 1.0–3.0%, preferably between about 1.6–2.3%, and more preferably between about 1.9–2.1%.

Silicon

Silicon is frequently employed in amounts of about 1% in hot work die steels to enhance the steels' resistance to softening in tempering. However, silicon can have an adverse affect on toughness. For example, as little as 0.80% Si reduced toughness significantly while providing only a minor improvement in tempered hardness. Thus, while a maximum of 1.50%, by weight, may be present in the steels of this invention, it is preferred to maintain the silicon at a level between about 0.20–1.0%, and more preferably in an amount between 0.30–0.50%.

Nickel

The addition of a small amount of nickel improves the secondary hardening reactions during tempering. High amounts may lead to problems with retained austenite. Thus, while nickel may be present in amounts up to 2.0%, by weight, a preferred maximum is about 0.5%, with the preferred range being about 0.25–0.35%

Manganese

Manganese imparts hardenability to steels. However, its effect on the hardenability of the steels of this invention is not needed due to the combined presence of chromium and molybdenum. As a consequence, little benefit is to be derived from the use of large amounts of manganese. The maximum amount is about 1.0%, by weight. However, it is preferred that some manganese be present, preferably about 0.20–0.40%, as manganese is required to tie up sulfur as MnS, rather than having the sulfur combined as FeS causing susceptability of the steel to hot shortness.

Heat Treatment

An integral part of this invention is the preferred heat treatment (austenize-quench-temper) given to the ferrous alloys hereof so as to achieve the desirable combination of properties, namely, (1) a high level of toughness on the order of 100 ft-lbs min. on unnotched specimens, (2) good wear resistance, (3) good machinability, and (4) a hardness of at least 56 HRC after said heat treatment. Earlier it was sought to emphasize the importance of a maximum austenitizing temperature of 1850° F. for the initial step of said heat treatment. The reasons for austenitizing at or below 1850° F. are many, but for convenience can be divided into two basic areas: furnace design considerations and metallurgical considerations.

The cost for furnaces capable of heat treating above 1850° F. are higher due to harsher requirements on refractories, furnace insulation, heating elements, ability to attain temperature uniformity, furnace door shape integrity, and operating requirements. For instance, as temperatures move higher, more fuel is needed to sustain the higher temperatures. As a consequence, more frequent maintenance becomes necessary.

In the area of metallurgical considerations, high temperatures, i.e. those greater than 1850° F., promote excessive scaling, decarburization and grain growth. Where scaling and decarburization may present problems, such must be solved through the use of controlled atmospheres or vacuum treatment. Unless those precautions are taken the affected surface layers have to be removed by grinding after heat treatment. As the amount of grinding required increases, the cost per knife increases.

Another metallurgical consideration is that higher austenitizing temperatures promote warping. Experience has shown that knife warping is difficult to control and correct.

It is thus apparent that if the properties of a steel can be optimized using a low austenitizing temperature, such steel is highly desirable as a commercial product, particularly to the heat treater and user. Table V presents data from a steel of this invention (0.51C-0.34Mn-0.020P-0.012S-0.40Si-0.32Ni-4.80Cr-1.99Mo-0.05Cu-0.024Al-bal.Fe) showing hardness and toughness values for various combinations of austenitizing and tempering.

TABLE V

| Austenitizing | DOUBLE TEMPER (°F.) | | | | | | | |
|---|---|---|---|---|---|---|---|---|
| | 940 | | 960 | | 980 | | 1000 | |
| Temp. (°F.) | HRC | CVN* | HRC | CVN* | HRC | CVN* | HRC | CVN* |
| 1975 | 58.5 | 5.7 | | | | | 59.3 | 5.5 |
| 1950 | 58.6 | 3.8 | | | | | 59.2 | 4.8 |
| 1925 | 58.6 | 4.7 | | | | | 59.2 | 5.8 |
| 1900 | 58.5 | 6 | | | | | 58.8 | 5.8 |
| 1850 | 58.7 | 5.3 | 59.5 | 5.2 | 6 | 57.7 | 7 | |
| 1825 | 58.2 | 6.7 | 57.7 | 7.5 | 57.7 | 7 | | |
| 1800 | 57.7 | 6.2 | | | | | | |
| 1775 | 56.2 | 6.7 | | | | | | |
| 1750 | 55 | 6.5 | | | | | | |
| 1725 | 54.2 | 6.5 | | | | | | |

*Charpy V-Notch Impact Strength (Ft-lbs @75° F.)

Even with austenitizing temperatures as low as 1775° F. it is possible to attain good toughness and a hardness of at least 56 HRC.

The tempering treatment is the final step in the heat treatment of the ferrous alloys of this invention. Multiple tempering steps are a rather common practice on high alloy tool steels. While double tempering is typical, triple tempering is practiced for the very high alloy grades. The reasons for multiple tempering steps center on dimensional stability and proper conditioning of retained austenite. The presence of unstable retained austenite, after an initial tempering step, may be detrimental to tool steel performance. There is the danger of cracking. As a consequence, a second tempering step is used. In those cases where some retained austenite transforms to as-quenched martensite after or during the initial tempering step, the second temper was found to relieve stresses caused by this transformation, and to make the freshly transformed martensite more ductile.

The ferrous alloys of the present invention, particularly when used as chipper knives, are subjected to frictional heat. Frictional heat, either general or localized, can cause softening which leads to dulling. As the knife looses its sharpness, frictional heat increases. In fact, impact with foreign objects can damage the chipping edge resulting in a build up of heat in the damaged area. It is possible for such damaged areas to be reaustenized. It was discovered that the double tempering treatment increased the insensitivity of the ferrous alloy of this invention to frictional heat. This enabled such alloy to resist dulling. As a part of the investigation on the tempering treatment, it was found that softening may result when the frictional heat increases the temperature of the knife above the tempering temperature. Thus, while a range of 940°–1020° F. is ideally suited as a tempering temperature for practicing the present invention, it is preferred to temper at temperatures above about 950° F.

I claim:

1. A wear resistant and machinable ferrous alloy consisting essentially of, by weight, carbon between about 0.40 to 0.60%, a maximum of about 1.0% manganese, a maximum of about 0.035% phosphorus, a maximum of about 0.035% sulfur, a maximum of about 1.50% silicon, a maximum of about 2.00% nickel, chromium between 4.4 and 5.2% molybdenum between 1.6 and 2.3%, a maximum of about 0.10% aluminum, a maximum of 0.52% niobium, and the balance essentially iron, said alloy having the capability of being austenitized at a temperature no higher than 1850° F., quenched and double tempered within the range of 940° to 1020° F. to produce a level of toughness of at least 100 ft-lbs on unnotched specimens, and a hardness of at least 56 HRC.

2. The ferrous alloy according to claim 1 wherein the carbon and silicon are present in amounts between about 0.45–0.50% and about 0.20–1.0%, respectively.

3. The ferrous alloy according to claim 2 wherein the silicon is present in an amount between about 0.30–0.50%.

4. The ferrous alloy according to claims 1, 2 or 3 wherein chromium is present in an amount between about 4.6–4.8%.

5. The ferrous alloy according to claims 1, 2 or 3 wherein molybdenum is present in an amount between about 1.9–2.1%.

6. The ferrous alloy according to claims 1, 2 or 3 wherein nickel is present in a maximum amount of about 0.50%.

7. The ferrous alloy according to claim 6 wherein nickel is present in an amount between about 0.25–0.35%.

8. The ferrous alloy according to claim 6 wherein manganese and aluminum are present in amounts between about 0.20–0.40% and about 0.010–0.030%, respectively.

* * * * *